US006241312B1

(12) United States Patent
Watts et al.

(10) Patent No.: US 6,241,312 B1
(45) Date of Patent: Jun. 5, 2001

(54) CONVERTIBLE BENCH/TABLE APPARATUS AND METHODS

(75) Inventors: Stephen P. Watts, Orem; M. Brent Norton, Provo, both of UT (US)

(73) Assignee: Premiere Products, Inc., Provo, UT (US)

( * ) Notice: Subject to any disclaimer, the term of this patent is extended or adjusted under 35 U.S.C. 154(b) by 0 days.

(21) Appl. No.: 09/184,736

(22) Filed: Nov. 2, 1998

(51) Int. Cl.[7] ..... A47B 85/04
(52) U.S. Cl. ..... 297/125; 297/440.23
(58) Field of Search ..... 297/118, 119, 297/124, 440.2, 451.11, 440.15, DIG. 2, 440.22, 440.17, 440.16, 440.23

(56) References Cited

U.S. PATENT DOCUMENTS

| | | | | |
|---|---|---|---|---|
| D. 046,770 | * | 12/1914 | Haase . | |
| 1,532,417 | | 4/1925 | Letts . | |
| 1,757,960 | | 5/1930 | Greenstreet . | |
| 1,890,129 | | 12/1932 | Ross . | |
| 2,481,935 | | 9/1949 | Larson | 155/43 |
| 2,506,852 | | 5/1950 | Barcus | 155/43 |
| 2,856,985 | | 10/1958 | Lepper | 155/124 |
| 2,882,957 | | 4/1959 | Anderson | 155/43 |
| 2,922,463 | | 1/1960 | Johnston | 155/43 |
| 2,959,209 | | 11/1960 | Lakin | 155/43 |
| 3,887,234 | * | 6/1975 | Curtis et al. . | |
| 4,521,052 | * | 6/1985 | Cone . | |
| 4,615,559 | | 10/1986 | Blondeau | 297/124 |
| 4,801,175 | * | 1/1989 | Albanese . | |
| 5,292,172 | | 3/1994 | Watts et al. | 297/127 |
| 5,398,990 | | 3/1995 | Watts et al. | 297/127 |
| 5,609,391 | | 3/1997 | Watts et al. | 297/127 |
| 5,692,799 | * | 12/1997 | Sheets . | |
| 5,718,475 | | 2/1998 | Watts | 297/127 |

OTHER PUBLICATIONS

Photographs of the prototype entitled, *5' Convert–A–Bench*, by Stephen P. Watts and information relating to trade show on Aug. 15, 1997 in Chicago, Illinois.

* cited by examiner

*Primary Examiner*—Milton Nelson, Jr.
(74) *Attorney, Agent, or Firm*—Kirton & McConkie; Berne S. Broadbent; Dale E. Hulse

(57) ABSTRACT

A support frame for use in a convertible bench/table apparatus. In one presently preferred embodiment of the present invention, the support frame includes an upper portion movably mounted to a lower portion. In such preferred embodiment, the lower portion includes a first leg, a second leg, and a seat mount, where the seat mount is comprised of an upper surface and a lower surface defining a space therebetween which is capable of receiving one or more seat members to form a seat. Further in such embodiment, the upper portion preferably has a backrest mount which includes a first surface and a second surface that define a space therebetween which is capable of receiving one or more backrest members to form a backrest.

44 Claims, 5 Drawing Sheets

CONVERTIBLE BENCH/TABLE APPARATUS AND METHODS

FIELD OF THE INVENTION

The present invention relates to furniture, and more particularly, to a novel support frame for a convertible bench/table apparatus and to novel convertible bench/table assemblies.

BACKGROUND

Persons owning homes are common consumers of recreational patio and pool furniture. In many instances, homeowners purchase patio and pool furniture for the convenience and comfort they provide when leisurely relaxing outside or near a pool. Consumers of recreational furniture usually have an interest in the aesthetic beauty of a piece of patio or pool furniture and intend such furnishings to enhance the settings of their homes and to add to the decor of their pool areas.

Outdoor benches have traditionally provided persons with a place to sit and relax outside in the yard, on the porch, or near the pool. Many homeowners purchase lawn benches made of natural woods and finish them with a weather protecting varnish to ensure the longevity of the wood against the elements of nature. Although lawn benches have traditionally provided a means of sitting and relaxing in an outdoor setting, when it comes time for eating, such benches provide no satisfactory surface for supporting the dinnerware or the food to be eaten.

Many homeowners have accordingly purchased picnic tables as an appropriate means for placing food and other items thereon and in order to provide appropriate surface space to accommodate such food or other items and to provide a place to sit while enjoying the meal. However, when the meal is completed, the seat or bench associated with the picnic table no longer provides a comfortable advantage to those individuals seeking to relax and enjoy the outdoor setting. Typically, the main option of comfort while sitting on the bench of a picnic table is to lean forward and rest one's elbows on the tabletop. Although a picnic table provides a great function while eating outdoors, when it comes time to relax and enjoy the pleasant outdoor weather while communicating with family or friends, a park bench would provide a more comfortable piece of furniture. Hence, many homeowners have consequently purchased both park bench and picnic table types of outdoor furniture for their use and enjoyment.

In view of the foregoing, attempts have been made by some to manufacture a convertible bench/table structure which provides a bench with a seat and backrest in one position, which can then be transformed into a seat with a tabletop structure, analogous to a picnic table, in another position. Although the presently known convertible park bench/picnic table devices afford significant advantages over the use of separate tables, benches, and chairs, significant disadvantages remain.

Naturally, consumers generally prefer products that include simple and easy means of operation. Unfortunately, however, the presently known convertible park bench/picnic table devices typically employ complicated mechanical laches and multiple pivotal points to accomplish a conformational transformation of the park bench into a picnic table for dining. Likewise, the components of such presently known devices often rely upon multiple working parts, a significant number of nut and bolt assemblies, and a plurality of pivotal joints to construct the final working unit. Because of the necessity of numerous mechanical parts in such devices, production and manufacturing costs are proportionately increased and ultimately passed on to the consumer.

In addition, the multiplicity of working parts, the arrangement of the various nut and bolt assemblies, and the array of pivotal joints in the final construction of presently known convertible bench/table structures, present the consumer with a generally frustrating assembly process. In many situations, the consumer ends up trying to read and interpret lengthy and somewhat complicated instructions to assemble such a convertible bench/table structure for use.

Another disadvantage of presently known convertible bench/table structures is the difficult and sometimes awkward means of converting the park bench into the picnic table conformation. In some instances, not only do pivotal pins have to be adjusted or frame members slidably modified in their adjacent slots, but with many known convertible table/bench devices, the repositioning of a backrest into a tabletop position requires more than one individual to accomplish.

The end result is that consumers can be called upon to make a lengthy investment of time in assembling their final working units. And with the numbers of mechanical working parts to assemble, the process of home construction can be an intense or frustrating experience, often forcing consumers to meticulously wade through in-depth and sometimes over technical instructions to realize any use from their "recreational" furniture.

BRIEF SUMMARY AND OBJECTS OF THE INVENTION

In view of the foregoing, it is a primary object of the present invention to provide a new and improved functional and structural design for convertible bench/tables.

An additional object of the present invention is to provide a reduction in the number of mechanical working parts that will effect a decrease in the overall manufacturing and production costs of a convertible bench/table and to provide a convertible bench/table which is relatively easy to manufacture.

Further, it is an object of the present invention to provide a convertible bench/table which is relatively easy to assemble.

Consistent with the foregoing objects, and in accordance with the invention as embodied and broadly described herein, a support frame for use in a convertible bench/table apparatus is disclosed in one presently preferred embodiment of the present invention as including an upper portion movably mounted to a lower portion. The lower portion preferably includes a first leg, a second leg, and a seat mount, where the seat mount is comprised of an upper surface and a lower surface defining a space therebetween which is capable of receiving one or more seat members to form a seat. The upper portion preferably has a backrest mount including a first surface and a second surface that define a space therebetween which is capable of receiving one or more backrest members to form a backrest.

To construct a convertible bench/table apparatus in accordance with the present invention, a user may acquire two such substantially symmetrical support frames, position one or more seat members between the seat mounts, and position one or more backrest members between the backrest mounts. So constructed, the upper portions of the support frames pivot relative to their respective lower portions so that the backrest may be positioned to either serve as a backrest or as a tabletop.

As summarized, the present invention provides a new and improved functional and structural design for convertible bench/tables. The novel support frame greatly reduces the number of mechanical working parts thereby decreasing the overall manufacturing and production costs of a convertible bench/table.

Not only is the manufacturing process simplified, but the end user's job of putting the convertible bench/table together and using it is greatly simplified as well. The convertible bench/table apparatus, as described herein, provides a convertible bench/table which is relatively easy to assemble.

Because of the design of the support frame, the upper and lower portions of the support frames can be molded of a single material. This further simplifies the manufacturing and assembling of the present invention. The molded spaces of the seat mount and backrest mount provide easy means for putting together the apparatus, with no need for multiple fasteners, nuts, bolts, screws, and the like.

The support frames are preferably molded of plastic. Being molded of plastic, the support frames can be strong yet lightweight relative to other convertible bench/table apparatus.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only exemplary embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

It will be readily understood that the components of the present invention, as generally described and illustrated in the figures herein, could be designed and arranged in a wide variety of different configurations. Thus, the following more detailed description of the embodiments of the systems and methods of the present invention, as represented in FIGS. 1 through 5, is not intended to limit the scope of the invention, as claimed, but it is merely representative of the presently preferred embodiments of the invention.

The presently preferred embodiments of the invention will be best understood by reference to the drawings, wherein like parts are designated by like numerals throughout.

Figure 1:
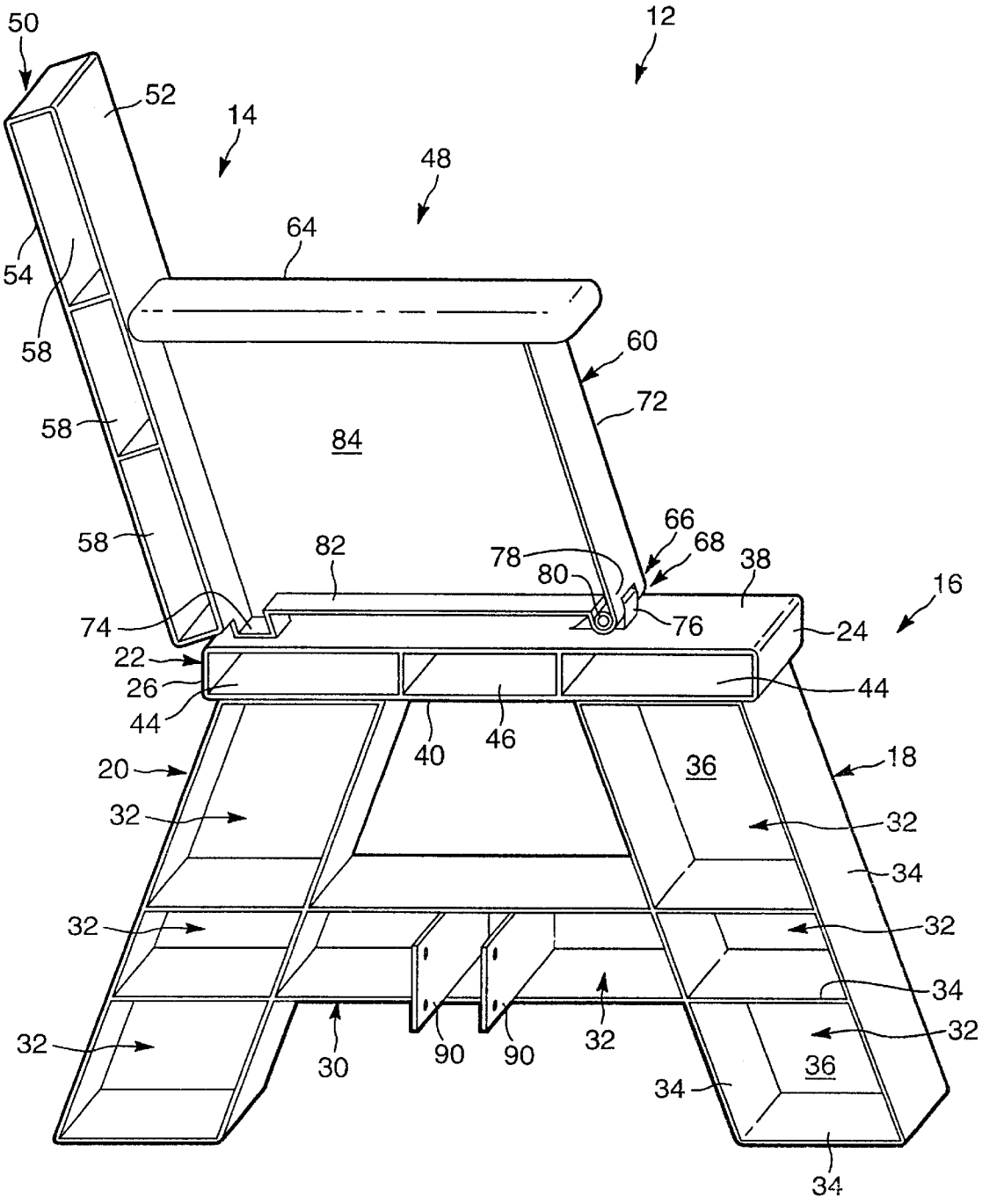
FIG. 1 is a perspective view illustrating one presently preferred embodiment of a support frame for a convertible bench/table apparatus, the support frame being shown in a first position.

FIG. 1 illustrates one presently preferred embodiment of a support frame 12 for use in a convertible bench/table apparatus 10 within the scope of the present invention, including an upper portion 14 movably mounted to a lower portion 16. The lower portion 16 includes a first leg 18, a second leg 20, and a seat mount 22. The first leg 18 is located adjacent a first end 24 of the lower portion 16, while the second leg 20 is located adjacent a second end 26 of the lower portion 16.

The legs 18, 20 are composed of a sturdy material with relative thickness and durability for supporting the seat 28 and weight applied thereon. The legs 18, 20 preferably vertically connect to the seat mount 22 at a slight angle from the base of each respective leg 18, 20, as shown. The height of the seat mount 22 is determined by the vertical length and height of the legs 18, 20 when positioned thereunder.

A leg brace 30 may be positioned between the first leg 18 and the second leg 20. The leg brace 30 horizontally engages the inner side of the two legs 18, 20.

Figure 2:
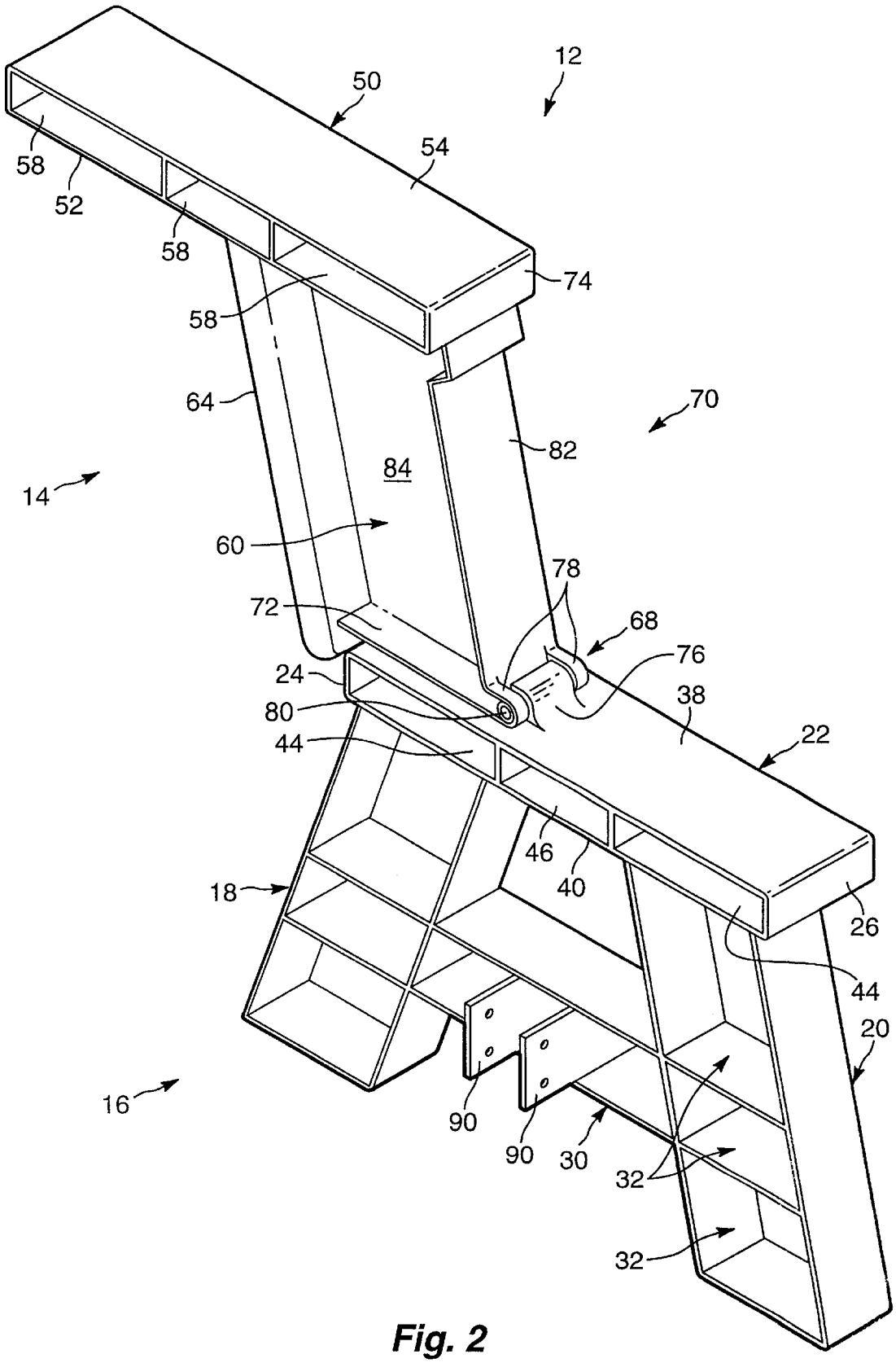
FIG. 2 is a perspective view illustrating the presently preferred embodiment of the support frame of FIG. 1, the support frame being shown in a second position.
Figure 3:
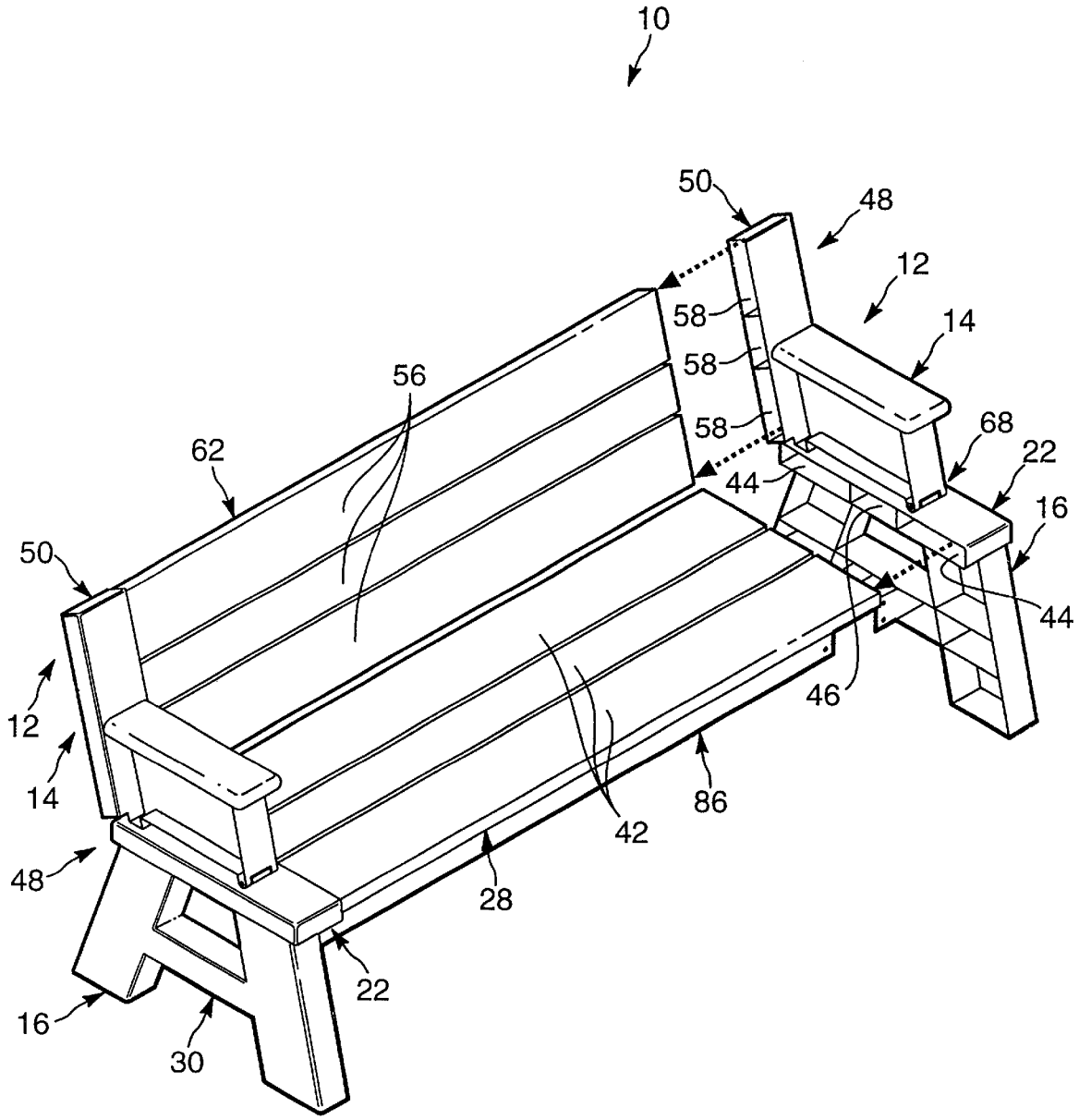
FIG. 3 is a partially assembled, perspective view of a presently preferred embodiment of a convertible bench/table apparatus within the scope of the present invention, the partially assembled convertible bench/table apparatus being in the first or bench position.
Figure 4:
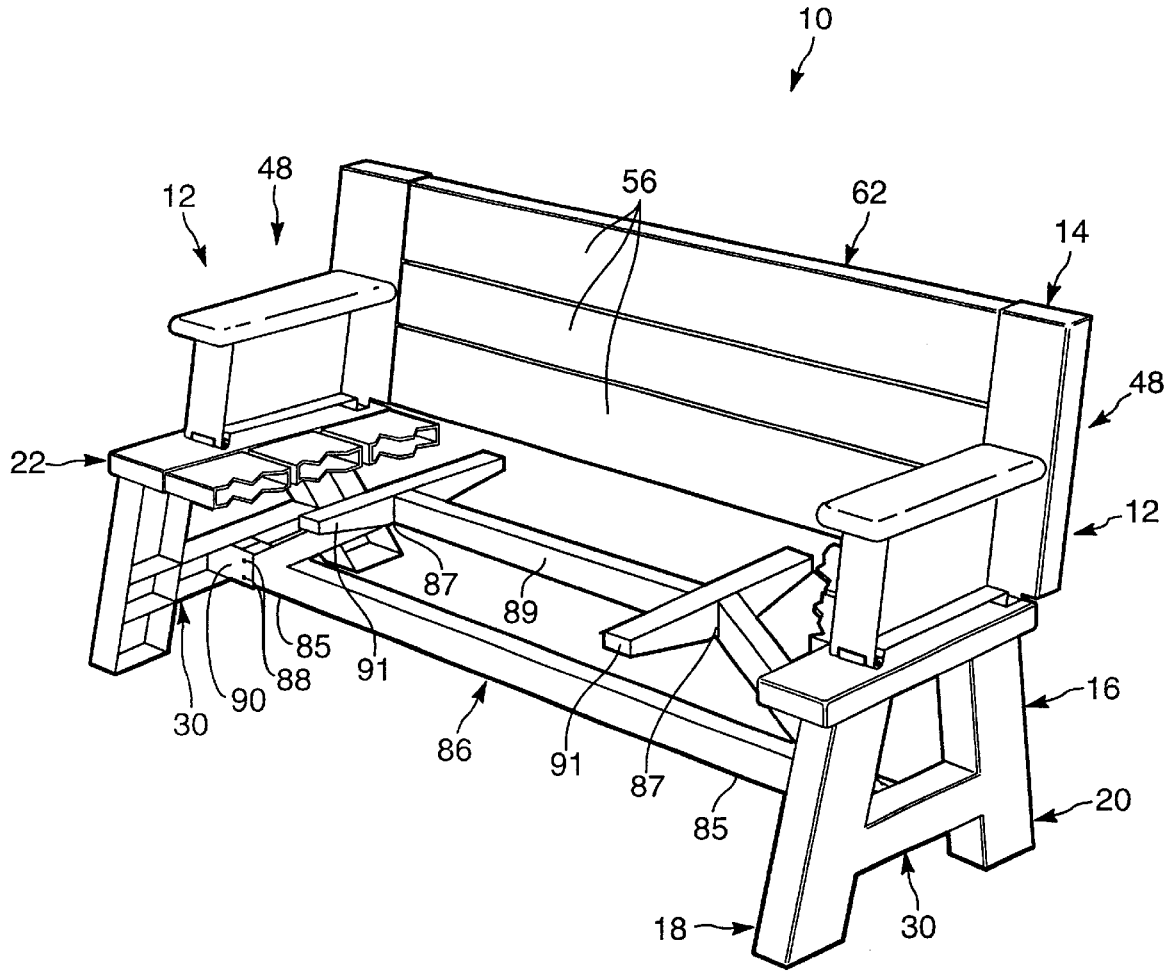
FIG. 4 is a perspective view of the convertible bench/table apparatus of FIG. 3, the view being partially cut away to show the truss brace, the convertible bench/table apparatus being in the first or bench position.
Figure 5:
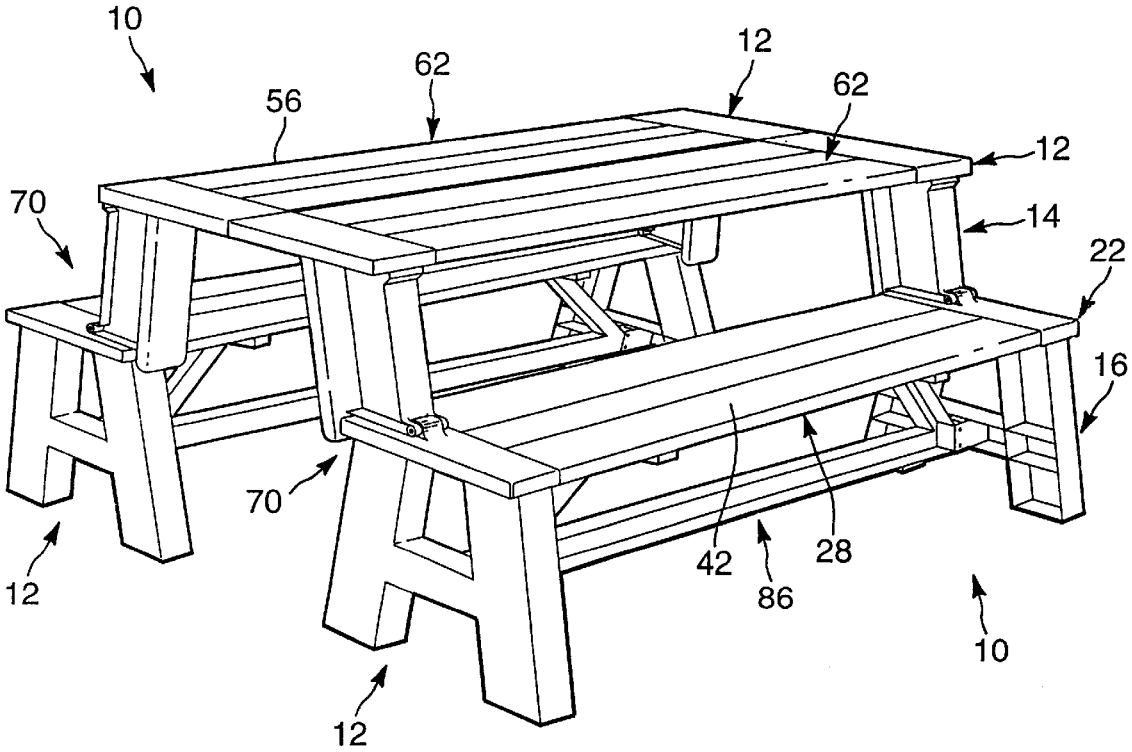
FIG. 5 is a perspective view of two convertible bench/table apparatus fashioned in accordance with FIG. 4 and positioned in mirror image fashion with respect to each other, each convertible bench/table apparatus being in the second or table position and being aligned to provide a larger tabletop surface, analogous to a conventional picnic table.

The legs 18, 20 and leg brace 30, in one presently preferred embodiment, may comprise a series of structural chambers 32 for ease in construction and to increase the structural integrity of the legs 18, 20 and leg brace 30. Each structural chamber 32 may include five walls, four sidewalls 34 and an outside wall 36. The side opposite the outside wall 36 of each structural chamber 32 is preferably left open, as shown in FIGS. 1 and 2 whereby the series of chambers 32 is viewable from the inside as shown in FIG. 1. The side is left open for ease of manufacturing the lower portion 16 as integral pieces. The outside view of the support frame 12 shows only a smooth surface, as shown in FIGS. 3, 4, and 5.

As shown, adjacent structural chambers 32 share sidewalls 34. The aggregation of structural chambers 32 makes up the legs 18, 20 and leg brace 30. Of course, it will be appreciated by those skilled in the art that the legs 18, 20 and leg brace 30 could be constructed in a variety of ways, including designing them without structural chambers 32.

The seat mount 22 comprises an upper surface 38 and a lower surface 40. The upper and lower surfaces 38, 40 define a space therebetween which is capable of receiving one or more seat members 42.

The space in between the upper and lower surfaces 38, 40 may be configured in a variety of ways to receive one or more seat members 42. In one presently preferred embodiment, as shown in FIG. 1, the seat mount 22 may be configured so as to include one or more compartments 44, 46 formed between the upper and lower surfaces 38, 40 for receiving one or more seat members 42. The sizes and shapes of the compartments 44, 46 may vary according to the size and shape of the seat members 42. It will be appreciated that those skilled in the art could design the seat mount 22 with one compartment formed between the upper and lower surfaces 38, 40, or with many compartments. Any reasonable number of compartments would fall within the scope of the present invention.

In one presently preferred embodiment the seat mount 22 includes three compartments 44, 46 for aesthetic reasons, and because of commonly found sizes of material that can be used as seat members 42 for a seat mount 22 configured with three compartments 44, 46. While the compartments 44, 46 may assume various sizes and shapes, in the embodiment shown in FIG. 1, the outer compartments 44 are similarly sized and configured, while the inner compartment 46 is smaller. As shown in FIG. 1, each compartment 44, 46 is open on one side so as to allow a seat member 42 to be inserted into the compartment 44, 46 as will be explained in more detail hereafter.

In one presently preferred configuration, the outer compartments 44 have a width of approximately 14.5 cm (about 5.5 inches), a height of approximately 4 cm (about 1.5 inches), and a depth of approximately 9.5 cm (about 3.75 inches). The inner compartment 46 has a width of approximately 9 cm (about 3.5 inches), a height of approximately 4 cm (about 1.5 inches), and a depth of approximately 9.5 cm (about 3.75 inches). The presently preferred lower portion 16 places a seat member 42 inserted into one of the compartments 44, 46 at a height of approximately 43.5 cm (about 17 inches). The presently preferred height of the support frame 12, when it is in a first or bench position 48, is approximately 80 cm (about 31.5 inches). The width of the entire convertible bench/table 10 varies according to the length of the seat and backrest members 42, 56 placed therein. In one presently preferred embodiment the width of the entire convertible bench/table 10 is approximately 1.8 meters (about 6 feet). Of course, it will be appreciated that the present invention could easily be constructed with any reasonable dimensions enabling a convertible bench/table 10 to be constructed and used.

The upper portion 14 includes a backrest mount 50. The backrest mount 50 includes a first surface 52 and a second surface 54 for defining a space therebetween which is capable of receiving one or more backrest members 56.

The space in between the first and second surfaces 52, 54 may be configured in a variety of ways to receive one or more backrest members 56. In one presently preferred embodiment, as shown in FIG. 1, the backrest mount 50 includes several compartments 58 formed between the first and second surfaces 52, 54 for receiving one or more backrest members 56. The compartments 58 of the backrest mount 50 may be configured substantially similar to the compartments 44, 46 of the seat mount 22.

The upper portion 14 preferably further includes a tabletop support 60 adjacent the backrest mount 50. Besides providing support for the tabletop 62, the tabletop support 60 also preferably provides an armrest 64 for a user when the upper portion 14 is in the first position 48 (i.e., when the convertible bench/table 10 is serving as a bench).

As indicated, the upper portion 14 is movably mounted to the lower portion 16. In one presently preferred embodiment a pivotable connection 66 provides this movable mounting. As shown in FIG. 1, the pivotable connection 66 may be a hinge 68 located at a lower portion 16 of the tabletop support 60.

The upper portion 14 is rotatable to a first position 48, as shown in FIG. 1, where the support frame 12 is capable of supporting a bench (or seat) 28 and a backrest 62. The upper portion 14 may be pivoted into a second position 70, as shown in FIG. 2, where the support frame 12 is capable of supporting a bench 28 and an adjacent tabletop 62. When the upper portion 14 is in the second position 70, the backrest mount 50 serves as a tabletop mount 50 in that the backrest 62 effectively becomes a tabletop 62.

In one presently preferred embodiment, the upper portion 14 includes a structural stop 72 for preventing movement of the upper portion 14 past the second position 70. In this regard, when a user desires to switch from the bench configuration 48 to the table configuration 70, the user pivots the upper portion 14 relative to the lower portion 16 until the structural stop 72 engages the lower portion 16. At this point, the support frame 12 is in the second position 70.

When a user wishes to convert the table back into the bench configuration, the user simply returns the upper portion 14 back to its original position by pivoting the upper portion 14 until a second structural stop 74 engages the lower portion 16. Thus, when the second structural stop 74 engages the lower portion 16, the support frame 12 is in the first position 48. The second structural stop 74 may be a lower surface of the backrest mount 50, or, as shown in FIG. 1, the second structural stop 74 may be an additional structure formed on the upper portion 14.

It will be appreciated by those skilled in the art that the upper and lower portions 14, 16 of the support frame 12 could be fabricated in a variety of ways. In one presently preferred embodiment, the upper portion 14 is formed as one integral piece, and the lower portion 16 is formed as one integral piece.

Different moldable materials may be used in forming the upper and lower portions 14, 16 as integral pieces. For example, the moldable material may be plastic, metal (e.g., aluminum), vinyl, or any other suitably moldable material.

FIG. 2 illustrates the support frame 12 of FIG. 1 in the second position 70 where it is capable of supporting a bench 28 and an adjacent tabletop 62. When the support frame 12 is in the second position 70, the backrest mount 50 and the seat mount 22 are preferably substantially parallel so that a seat 28 and a tabletop 62 being supported by the support frame 12 would also be substantially parallel.

The illustration of FIG. 2 also depicts a hinge 68 that may be formed by a first hinge member 76, formed on the lower portion 16, being operably connected to a second hinge member 78, formed on the upper portion 14, by a hinge pin 80. Thus constructed, the upper portion 14 may freely pivot from its first 48 to its second position 70, and vice versa.

In one presently preferred embodiment, the tabletop support 60 is composed of a base member 82; a planar member 84, rectangular in shape and comprising a majority of the body of the tabletop support 60, where the height of the planar member 84 directly relates to the height of the tabletop 62 when the convertible bench/table 10 is in a second position 70 as represented in FIGS. 2 and 5; and an armrest 64 resting on top of the planar member 84 and preferably extending transversely a greater length than the base member 82 and the planar member 84. The combination of the base member 82, the planar member 84, and the armrest 64 comprises the tabletop support 60 and each member thereof, in one presently preferred embodiment, is preferably integrally molded with the upper portion 14. Although less preferred, in an alternative embodiment, each member of the tabletop support 60 assembly could be affixed to each other by fasteners, such as, for example, an epoxy adhesive, furniture glue, multiple screws (or bolts), and the like.

In current design, the tabletop support 60 is constructed as an I-beam, where the armrest 64 and base member 82 serve as the flanges and the planar member 84 serves as the vertical portion of the I-beam. The I-beam provides substantial structural support for the weight to be placed thereon. However, the tabletop support 60 could be constructed in a variety of other ways. For example, the tabletop support 60 could be rectangular in nature, rather than an I-beam, or it could be a solid member (not shown) spanning from the armrest 64 to the base member 82.

FIG. 3 illustrates one presently preferred embodiment of a convertible bench/table apparatus 10 within the scope of the present invention which is only partially assembled for purposes of illustration and explanation. A plurality of seat members 42 and backrest members 56, preferably similar in construction, are provided and are made of a substance of sufficient strength to support the forces that may be applied to the seat 28 and backrest/tabletop 62, respectively. For example, the seat and backrest members 42, 56 may be made of wood, plastic, metal (e.g., aluminum), vinyl, or any other suitable material.

As shown, the seat members 42 and backrest members 56 are inserted within the seat mount 22 and backrest mount 50, respectively, to provide a seat 28 and a backrest/tabletop 62. In one presently preferred embodiment, as discussed in relation to FIG. 1, the seat mount 22 and backrest mount 50 include several compartments 44, 46, 58. The seat members 42 are constructed so that they snugly fit into the compartments 44, 46 whereby they may be substantially kept fixed in a position. Likewise, the backrest members 56 are constructed so that they fit snugly into the compartments 58 of the backrest mount 50. Generally, the greater the depth of the compartments 44, 46, 58, the more stable the seat 28 and backrest 62 will be.

In the presently preferred embodiment as described, the seat members 42 and backrest members 56 frictionally fit into the seat mount 22 and backrest mount 50, respectively. The present invention thus has no need to use glue, nut and bolt assemblies, or the like to connect the members 42, 56 to their respective mounts 22, 50 because of the frictionally fitting. This reduces the number of mechanical parts and time needed to assemble the present invention thereby making the present invention easier for consumers to assemble and use than other related devices. It will be appreciated that a different design could be used for the seat 42 and backrest members 56 that utilize glue, nut and bolt assemblies, or the like. However, such a design would not benefit from the advantages of the presently preferred embodiment as shown and described herein.

In one presently preferred embodiment of the present invention, the compartments 44, 46 of the seat mount 22 are substantially similar, if not identical, in size and configuration to the corresponding compartments 58 of the backrest mount 50, such that the seat members 42 and backrest members 56 may be made of corresponding size so as to be interchangeable. Thus designed, a manufacturer can simply construct one set of members, irrespective of whether they are to be used for the seat 28 or for the backrest 62. However, it will be appreciated that the seat members 42 and backrest members 56 need not have similar characteristics, and thus, need not necessarily be designed to be interchangeable.

The convertible bench/table apparatus 10 of the present invention is relatively simple to assemble. A user needs only two substantially symmetrical support frames 12, and the appropriate number of seat members 42 and backrest members 56. To assemble the convertible bench/table 10, a user need only insert each end of each seat member 42 into the corresponding compartments 44, 46 of the opposing seat mounts 22 as shown in FIG. 3. To provide the backrest/tabletop 62, a user need only insert each end of each backrest member 56 into the corresponding compartments 58 of the opposing backrest mounts 50 Thus disclosed, the present invention provides a relatively simple method for assembly with no need for glue, nails, nut and bolt assemblies, fasteners, or the like.

Once completely assembled, the convertible bench/table apparatus 10 appears as shown in FIG. 4. FIG. 4 shows the convertible bench/table 10 in the first or bench position 48.

Structural strength and stability may be added to the convertible bench/table 10 by adding one or more braces to the apparatus 10. As can be seen from FIG. 4, a truss brace 86 includes a top member 89 and a bottom member having two ends 85. The truss brace 86 may be provided to provide support to the convertible bench/table apparatus 10.

In one presently preferred embodiment, the truss brace 86 is attached to the bench/table 10 by connecting each end 85 of the truss brace 86 to the adjoining leg brace 30 by fasteners, such as screws 88 (or bolts), being passed through the truss brace 86 and further introduced into adjoining bench brace brackets 90 included on the leg braces 30.

As shown, the truss brace 86 includes two slots 87 formed in the top member 89. The slots 87 may be sized to fit supporting members therein. In the presently preferred embodiment, cross braces 91 are placed in the slots 87. Thus, in current design the cross braces 91 are separate pieces from the truss brace 86. Each cross brace 91 may fit into its corresponding slot 87 such that the cross brace 91 is substantially perpendicular to the top member 89.

In the preferred embodiment shown in FIG. 4, cross braces 91 are placed within the slots 87 so as to provide support for the seat members 42. In one presently preferred embodiment, the cross braces 91 frictionally fit into the slots 87. As shown, the seat members 42 lay across the cross braces 91. So connected, the truss brace assembly 86 provides support and strength to the bench/table apparatus 10. Of course, it will be appreciated by those skilled in the art that the cross braces 91 could be fixed to the top member 89 rather than simply frictionally fitting into the slots 87. In current design, the truss brace assembly 86 is made of vinyl. Other materials that could be used in constructing the truss brace assembly 86 include plastic, wood, metal, and the like.

It will be appreciated by those skilled in the art that other structures could be provided to increase the overall strength of the convertible bench/table 10. For example, a piece (not shown) of wood could be connected between the brackets 90 on the leg braces 30. In one alternative preferred embodiment, the brace brackets 90 may be formed to fit a standard two-by-four therebetween and therein. To use a standard two-by-four with appropriately formed brace brackets 90, holes would be made in the ends of the two-by-four (not shown) whereby the two-by-four could be connected to the brace brackets 90 by fasteners, such as screws.

In an alternative embodiment, the truss brace 86 may be connected to the leg brace 30 and seat members 42 through compartments (not shown). Such compartments (not shown) may be constructed similarly to the compartments 44, 46 of the seat mount 22 such that the truss brace 86 frictionally fits into the compartments (not shown). A benefit from a truss brace 86 so connected to the present invention is that the use of nuts, bolts, screws, or other fasteners is avoided.

In an alternative preferred embodiment, the cross braces 91, toward the center of the convertible bench/table apparatus 10, may be connected to the bottom of one or more seat members 42 by any suitable means such as a connection bracket (not shown). The connection bracket (not shown) may be similar to the bench brace bracket 90. The connection bracket (not shown) may be secured to one or more seat members 42 through a variety of ways. For example, bolts, screws, clips, and similar fasteners could be used to secure the connection bracket (not shown) to the bottom of one or more seat members 42.

FIG. 5 illustrates two convertible bench/table apparatus 10, both in their table positions 70, placed together so as to form a complete picnic table.

The support frames 12 of the present invention are preferably constructed of plastic. The seat members 42, backrest members 56, and the truss brace assembly 86 may be constructed of a number of materials, preferably plastic or wood. However, other suitable materials may be used in the construction of the support frame 12 and seat 42 and backrest members 56 such as vinyl, other types of woods or wood products, any of numerous organic, synthetic or processed materials that are mostly thermoplastic or thermosetting polymers of high molecular weight and that can be molded, cast, extruded, drawn or laminated, fiberglass composite materials, metals, or any other suitable material sufficient to accommodate the novel functional and structural elements and features of the present invention. Preferably, material(s) used in constructing the present invention is/are moldable so that the different major portions may be formed as integral pieces.

Overall, the structure and design of the present invention and its corresponding convertible bench/table are aesthetically pleasing to the eye and furnish a pleasant seating and/or dining experience for those persons leisurely relaxing in the yard, on the porch, or near the pool. Moreover, the presently preferred embodiments of the convertible bench/table apparatus can also be used indoors for sitting, dining, or as a workstation when converted into the tabletop (or desktop) formation.

In use, for example, if a family wants to eat out on the lawn, near the pool, or at a nearby campground, the necessary support frames and seat and backrest members needed to construct a convertible bench/table apparatus can be conveniently placed into the back of a truck for easy transportation to the campground, where they can be quickly and easily converted into a suitable picnic table on site. By pivoting the upper portion, accomplished by the hinge, the backrest can be transformed into a tabletop (or desktop) providing a surface area for a family picnic or for accommodating other activities.

If a longer tabletop is required to feed family and friends, dual pairs of convertible bench/tables of the present invention can be transformed into their tabletop formations and placed end to end, thus aligning the dual pairs of tabletops together to form a single longer tabletop with sturdy seats on the opposite sides thereof.

From the above discussion, it will be appreciated that the present invention provides a new and improved functional and structural design for convertible bench/table structures. The invention provides an aesthetically pleasing piece of recreational furniture. Additionally, the present invention has a reduced number of mechanical working parts, as compared to prior art devices, thereby effecting a decrease in the overall manufacturing and production costs.

The apparatus of the present invention is easy to assemble, and provides a simple, easy means for converting a bench structure into a picnic table (or desktop) formation.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A support frame for use in a convertible bench/table apparatus, comprising:

a lower portion comprising:

a first leg;

a second leg; and a seat mount, said seat mount comprising an upper surface and a lower surface in a fixed position relative to one another, said upper surface and said lower surface defining a fixed space therebetween which is capable of receiving at least one seat member; and an upper portion movably mounted to said lower portion, said upper portion comprising a backrest mount.

2. A support frame as defined in claim 1 wherein said seat mount comprises a plurality of compartments formed between said upper surface and said lower surface, said compartments being configured so as to be capable of receiving a plurality of seat members.

3. A support frame as defined in claim 1 wherein said upper portion is formed as one integral piece.

4. A support frame as defined in claim 1 wherein said lower portion is formed as one integral piece.

5. A support frame as defined in claim 1 wherein said upper portion is movably mounted to said lower portion by a pivotable connection.

6. A support frame as defined in claim 1 wherein said lower portion further comprises a leg brace positioned between said first leg and said second leg.

7. A support frame as defined in claim 1 wherein said backrest mount comprises a first surface and a second surface, said first surface and said second surface defining a space therebetween which is capable of receiving at least one backrest member.

8. A support frame as defined in claim 7 wherein said backrest mount comprises a plurality of compartments formed between said first surface and said second surface, said compartments being configured so as to be capable of receiving a plurality of backrest members.

9. A support frame as defined in claim 1 wherein said upper portion further comprises a tabletop support adjacent said backrest mount.

10. A support frame as defined in claim 9 wherein said tabletop support is pivotably connected to said lower portion at one end of said tabletop support, whereby said upper portion is pivotable relative to said lower portion.

11. A support frame as defined in claim 9 wherein said tabletop support is configured so as to provide an armrest when said upper portion is in said first position.

12. A support frame as defined in claim 1 wherein said upper portion is rotatable to a first position where said support frame is capable of supporting a bench and a backrest and wherein said upper portion is pivotable to a second position where said support frame is capable of supporting a bench and a tabletop.

13. A support frame as defined in claim 12 wherein said backrest mount is configured so as to provide a tabletop mount when said upper potion is in said second position.

14. A support frame as defined in claim 12 wherein said upper portion further comprises a structural stop for preventing movement of said upper portion relative to said lower portion past said second position.

15. A support frame as defined in claim 12 wherein said upper portion further comprises a second structural stop for preventing movement of said upper portion relative to said lower portion past said first position.

16. A support frame for use in a convertible bench/table apparatus, comprising:

a lower portion comprising:

a first leg;

a second leg; and a seat mount, said seat mount comprising an upper surface and a lower surface, said upper surface and said lower surface defining a space therebetween which is capable of receiving at least one seat member; and an upper portion movably mounted to said lower portion, said upper portion comprising a backrest mount that comprises a first surface and a second surface, said first surface and said second surface defining a plurality of compartments formed between said first surface and said second surface, said compartments being configured to receive a plurality of backrest members.

17. A support frame for use in a convertible bench/table apparatus, comprising:

a lower portion having a first end and a second end, said lower portion comprising:

a first leg adjacent said first end;

a second leg adjacent said second end; and a seat mount, said seat mount comprising a plurality of compartments which are capable of receiving a plurality of seat members; and an upper portion pivotably mounted to said lower portion, said upper portion being rotatable to a first position where said support frame is capable of supporting a bench and a backrest, and said upper portion being rotatable to a second position where said support frame is capable of supporting a bench and a tabletop, said upper portion comprising:

a backrest mount, said backrest mount comprising a plurality of compartments which are capable of receiving a plurality of backrest members.

18. A support frame as defined in claim 17 wherein said upper portion further comprises a tabletop support connected to said backrest mount, said tabletop support being pivotably connected to said lower portion at said first end, whereby said upper portion is pivotably mounted to and rotatable relative to said lower portion.

19. A support frame as defined in claim 18 wherein said upper portion is pivotably mounted to said lower portion by a hinge.

20. A support frame as defined in claim 19 wherein said tabletop support further comprises a structural stop for engaging said lower portion, thereby preventing further rotation of said upper portion past said second position.

21. A support frame as defined in claim 20 wherein said upper portion further comprises a second structural stop for engaging said lower portion, thereby preventing further rotation of said upper portion past said first position.

22. A support frame as defined in claim 21 wherein said second structural stop is a lower surface of said backrest mount.

23. A kit for assembling a convertible bench/table, comprising:

a right support frame and a left support frame which are substantially symmetrical, each said right and left support frame comprising:

a lower portion comprising:

a first leg;

a second leg; and a seat mount, said seat mount comprising an upper surface and a lower surface, said upper surface and said lower surface defining a space therebetween which is capable of receiving at least one seat member; and an upper portion movably mounted to said lower portion, said upper portion comprising a backrest mount, said backrest mount comprising a first surface and a second surface, said first surface and said second surface defining a space therebetween which is capable of receiving at least one backrest member.

24. A kit as defined in claim 23 wherein said right and left support frames are made of plastic.

25. A kit as defined in claim 23 wherein said right and left support frames are made of metal.

26. A kit as defined in claim 23 wherein said right and left support frames are made of aluminum.

27. A kit as defined in claim 23 wherein said right and left support frames are made of vinyl.

28. A kit as defined in claim 23 wherein said at least one seat member is made of plastic.

29. A kit as defined in claim 23 wherein said at least one seat member is made of wood.

30. A kit as defined in claim 23 wherein said at least one seat member is made of vinyl.

31. A kit as defined in claim 23, said at least one seat member is made of metal.

32. A kit as defined in claim 23 wherein said at least one seat member is made of aluminum.

33. A kit as defined in claim 23 wherein said at least one backrest member is made of plastic.

34. A kit as defined in claim 23 wherein said at least one backrest member is made of wood.

35. A kit as defined in claim 23 wherein said at least one backrest member is made of vinyl.

36. A kit as defined in claim 23 further comprising a truss brace capable of being positioned between said lower portions.

37. A kit as defined in claim 23 wherein said at least one backrest member is made of metal.

38. A kit as defined in claim 23 wherein said at least one backrest member is made of aluminum.

39. A kit as defined in claim 23 wherein said right support frame and said left support frame are made of plastic, wherein said at least one seat member is made of plastic, and wherein said at least one back rest member is made of plastic.

40. A kit as defined in claim 23 wherein said right support frame and said left support frame are made of plastic, wherein said at least one seat member is made of wood, and wherein said at least one back rest member is made of wood.

41. A kit as defined in claim 23 wherein said right support frame and said left support frame are made of plastic, wherein said at least one seat member is made of vinyl, and wherein said at least one back rest member is made of vinyl.

42. A support frame for use in a convertible bench/table apparatus, comprising:

a lower portion comprising:

a first leg;

a second leg; and a seat mount, said seat mount comprising an upper surface and a lower surface, said upper surface and said lower surface defining a space there between which is capable of receiving at least one seat member; and an upper portion movably mounted to said lower portion, said upper portion comprising a backrest mount and a tabletop support adjacent said backrest mount and wherein said tabletop support is pivotally connected to said lower portion at one end of said tabletop support, said upper portion can pivot relative to said lower portion.

43. A support frame for use in a convertible bench/table apparatus, comprising:

a lower portion comprising:

a first leg;

a second leg; and a seat mount, said seat mount comprising an upper surface and a lower surface, said upper surface and said lower surface defining a space there between which is capable of receiving at least one seat member; and an upper portion movably mounted to said lower portion, said upper portion comprising a backrest mount and a tabletop support adjacent said backrest mount and wherein said tabletop support is configured so as to provide an armrest when said upper portion is in said first position.

44. A support frame for use in a convertible bench/table apparatus, comprising:

a lower portion comprising:

a first leg;

a second leg; and a seat mount, said seat mount comprising an upper surface and a lower surface, said upper surface and said lower surface defining a space therebetween which is capable of receiving at least one seat member; and an upper portion movably mounted to said lower portion, said upper portion comprising a backrest mount and wherein said seat mount comprises a plurality of compartments formed between said upper surface and said lower surface, said compartments being configured to receive a plurality of seat members.

* * * * *

UNITED STATES PATENT AND TRADEMARK OFFICE

CERTIFICATE OF CORRECTION

PATENT NO. : 6,241,312 B1
DATED : June 5, 2001
INVENTOR(S) : Stephen P. Watts and M. Brent Norton It is certified that error appears in the above-identified patent and that said Letters Patent is hereby corrected as shown below:

Column 10,
Line 55, change "potion" to -- portion --

Column 12,
Line 19, after "claim 23" insert -- wherein --

Signed and Sealed this

Twenty-second Day of October, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,241,312 B1 
DATED : June 5, 2001
INVENTOR(S) : Stephen P. Watts and M. Brent Norton It is certified that error appears in the above-identified patent and that said Letters Patent is hereby corrected as shown below:

Column 10,
Line 55, change "potion" to -- portion --

Column 12,
Line 19, after "claim 23" insert -- wherein --

Signed and Sealed this

Twenty-ninth Day of October, 2002

*Attest:*

*Attesting Officer*

JAMES E. ROGAN
*Director of the United States Patent and Trademark Office*